US010805715B2

(12) United States Patent
Alexander

(10) Patent No.: US 10,805,715 B2
(45) Date of Patent: Oct. 13, 2020

(54) MTM LOUDSPEAKER USING TWEETER ARRAYS

(71) Applicant: Eric Jay Alexander, Orem, UT (US)

(72) Inventor: Eric Jay Alexander, Orem, UT (US)

( * ) Notice: Subject to any disclaimer, the term of this patent is extended or adjusted under 35 U.S.C. 154(b) by 0 days.

(21) Appl. No.: 15/982,969

(22) Filed: May 17, 2018

(65) Prior Publication Data

US 2018/0338203 A1 Nov. 22, 2018

Related U.S. Application Data

(60) Provisional application No. 62/507,218, filed on May 17, 2017.

(51) Int. Cl.

| | |
|---|---|
| ***H04R 1/26*** | (2006.01) |
| ***H04R 3/14*** | (2006.01) |
| ***H04R 9/06*** | (2006.01) |
| ***H04R 1/40*** | (2006.01) |

(52) U.S. Cl.

CPC ..... *H04R 1/26* (2013.01); *H04R 1/403* (2013.01); *H04R 3/14* (2013.01); *H04R 9/063* (2013.01); *H04R 2201/405* (2013.01); *H04R 2203/12* (2013.01); *H04R 2499/13* (2013.01)

(58) Field of Classification Search

CPC . H04R 1/26; H04R 1/403; H04R 3/14; H04R 5/02; H04R 5/04; H04R 9/063; H04R 2205/022; H04R 2499/13; H04R 2203/12; H04R 2201/405; H04R 2430/20

USPC ... 381/300, 304, 305, 89, 335, 99, 182, 184, 381/186, 386; 181/144, 145, 147, 199

See application file for complete search history.

(56) References Cited

U.S. PATENT DOCUMENTS

| | | | | |
|---|---|---|---|---|
| 3,308,237 A * | 3/1967 | Novak | H04R 1/403 381/98 |
| 4,884,655 A * | 12/1989 | Freadman | H04R 1/26 181/145 |
| 6,628,793 B1 * | 9/2003 | Porzilli | H04R 1/403 181/144 |
| 8,160,268 B2 * | 4/2012 | Horbach | H04R 1/26 381/89 |

* cited by examiner

*Primary Examiner* — Huyen D Le

(74) *Attorney, Agent, or Firm* — Kirton McConkie; Adam D. Stevens

(57) ABSTRACT

An MTM loudspeaker in which an array of smaller drivers replaces each of the larger drivers in a traditional MTM design. Doing so reduces the total moving mass of the drivers reproducing the lower-frequency sounds in the MTM design, while still allowing enough air to be moved for the loudspeaker to reproduce sounds in lower frequency ranges that would normally be produced by the larger drivers and could not be adequately produced by a single instance of the smaller driver. For example, a single tweeter or supertweeter, or a pair of tweeters or supertweeters still serves a traditional tweeter or tweeter function in the MTM design (handling high frequencies), but a plurality of tweeters or supertweeters arranged in two arrays placed on either side of the tweeter(s) or supertweeter(s) handling high frequencies is tasked with reproducing lower frequencies not traditionally handled in loudspeakers by tweeters or supertweeters.

20 Claims, 14 Drawing Sheets

MTM LOUDSPEAKER USING TWEETER ARRAYS

CROSS-REFERENCE TO RELATED APPLICATIONS

This application claims the benefit of U.S. Provisional Application No. 62/507,218, filed May 17, 2017, which is incorporated herein by reference for all it discloses, and is related to U.S. Pat. No. 9,247,339, issued Jan. 26, 2016, which is incorporated herein by reference for all it discloses.

BACKGROUND OF THE INVENTION

1. Field of the Invention

The present invention relates to loudspeakers and more particularly to a midwoofer-tweeter-midwoofer loudspeaker design incorporating a plurality of smaller drivers to provide a low-moving-mass substitute for a pair of larger drivers.

2. Background and Related Art

The midwoofer-tweeter-midwoofer (MTM) loudspeaker configuration was created as a way of correcting the lobe tilting of a typical mid-tweeter configuration. While the typical MTM design corrects some aspects of lobe tilting inherent in mid-tweeter configurations, problems remain with typical MTM designs, including interactions between the two midwoofer drivers that create off-axis lobing patterns. Additionally, traditional midwoofer drivers have sufficient mass so as to be unable to accurately reproduce sounds that were originally recorded from, for example, instruments having relatively low moving masses, as disclosed in U.S. Pat. No. 9,247,339. The result is that traditional MTM designs are unable to produce sounds as accurately as might be desired.

BRIEF SUMMARY OF THE INVENTION

Implementation of the invention provides an MTM loudspeaker in which an array of smaller drivers replaces each of the larger drivers in a traditional MTM design. Doing so reduces the total moving mass of the drivers reproducing the lower-frequency sounds in the MTM design, while still allowing enough air to be moved for the loudspeaker to reproduce sounds in lower frequency ranges that would normally be produced by the larger drivers and could not be adequately produced by a single instance of the smaller driver. For example, a single tweeter or supertweeter, or a pair of tweeters or supertweeters still serves a traditional tweeter or tweeter function in the MTM design (handling high frequencies), but a plurality of tweeters or supertweeters arranged in two arrays placed on either side of the tweeter(s) or supertweeter(s) handling high frequencies is tasked with reproducing lower frequencies not traditionally handled in loudspeakers by tweeters or supertweeters.

According to certain implementations of the invention, a loudspeaker includes a front panel. A first array of a plurality of a first type of speaker drivers is positioned on the front panel, the first array serving in the place of a first larger type of speaker driver. A second array of a plurality of the first type of speaker driver is positioned on the front panel, the second array serving in the place of a second of the larger type of speaker driver. A single instance of the first type of speaker driver is positioned on the front panel equidistantly between the first array and the second array. A crossover is configured to pass a first audio signal encompassing an upper frequency range with a lower frequency range filtered out to the single instance of the first type of speaker driver and to pass a second audio signal encompassing the lower frequency range with the higher frequency range filtered out to all the speaker drivers of the first and second arrays. The first type of speaker driver may be a supertweeter, a tweeter, a mid-range driver or a midwoofer driver. Each of the arrays may have any number of the first type of speaker driver, such as two, three, four, five, six, seven, or more drivers.

In some instances, an additional larger speaker driver may be positioned on the front panel such that the first array is positioned between the additional larger speaker driver and the single instance of the first type of speaker driver. Similarly, a second additional larger speaker driver may be positioned on the front panel such that the second array is positioned between the second additional larger speaker driver and the single instance of the first type of speaker driver. In some instances, four additional mid-sized speaker drivers of a size between the size of the first type of speaker driver and the additional larger speaker driver may be provided, with a pair of the mid-sized speaker drivers being positioned on the front panel between one of the arrays and the nearest larger speaker driver. In other instances, two additional mid-sized speaker drivers of a size between the size of the first type of speaker driver and the additional larger speaker driver, with one of the mid-sized speaker drivers being positioned on the front panel between each of the arrays and the nearest larger speaker driver. In additional instances, an additional still-larger speaker driver may be positioned on the front panel apart from the first and second arrays and the single instance of the first type of speaker driver.

According to additional implementations of the invention, a loudspeaker includes a front panel. A first array of a plurality of a first type of speaker drivers is positioned on the front panel, the first array serving in the place of a first larger type of speaker driver. A second array of a plurality of the first type of speaker driver is positioned on the front panel, the second array serving in the place of a second of the larger type of speaker driver. Two instances of the first type of speaker driver are positioned on the front panel equidistantly between the first array and the second array. A crossover is configured to pass a first audio signal encompassing an upper frequency range with a lower frequency range filtered out to the two instances of the first type of speaker driver and to pass a second audio signal encompassing the lower frequency range with the higher frequency range filtered out to all the speaker drivers of the first and second arrays. The first type of speaker driver may be a supertweeter, a tweeter, a mid-range driver or a midwoofer driver. Each of the arrays may have any number of the first type of speaker driver, such as two, three, four, five, six, seven, or more drivers.

In some instances, an additional larger speaker driver may be positioned on the front panel such that the first array is positioned between the additional larger speaker driver and the two instances of the first type of speaker driver. Similarly, a second additional larger speaker driver may be positioned on the front panel such that the second array is positioned between the second additional larger speaker driver and the two instances of the first type of speaker driver. In some instances, four additional mid-sized speaker drivers of a size between the size of the first type of speaker driver and the additional larger speaker driver may be provided, with a pair of the mid-sized speaker drivers being positioned on the front panel between one of the arrays and the nearest larger speaker driver. In other instances, two additional mid-sized speaker drivers of a size between the size of the first type of speaker driver and the additional larger speaker driver, with one of the mid-sized speaker drivers being positioned on the front panel between each of the arrays and the nearest larger speaker driver. In additional instances, an additional still-larger speaker driver may be positioned on the front panel apart from the first and second arrays and the two instances of the first type of speaker driver.

According to further implementations of the invention, a loudspeaker includes a front panel, a first array of a plurality of tweeters positioned on the front panel, the first array serving in the place of a first larger type of speaker driver, and a second array of a plurality of the tweeters positioned on the front panel, the second array serving in the place of a second of the larger type of speaker driver. The speaker also includes a single instance of the tweeter, positioned on the front panel equidistantly between the first array and the second array and a crossover configured to pass a first audio signal encompassing an upper frequency range with a lower frequency range filtered out to the single instance of the tweeter and to pass a second audio signal encompassing the lower frequency range with the higher frequency range filtered out to all the tweeters of the first and second arrays.

The loudspeaker may also include an additional larger speaker driver positioned on the front panel such that the first array is positioned between the additional larger speaker driver and the single instance of the tweeter. The loudspeaker may also include a second additional larger speaker driver positioned on the front panel such that the second array is positioned between the second additional larger speaker driver and the single instance of the tweeter. Each of the first and second arrays may have any number of tweeters, such as two, three, four, five, six, seven, or more tweeters.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
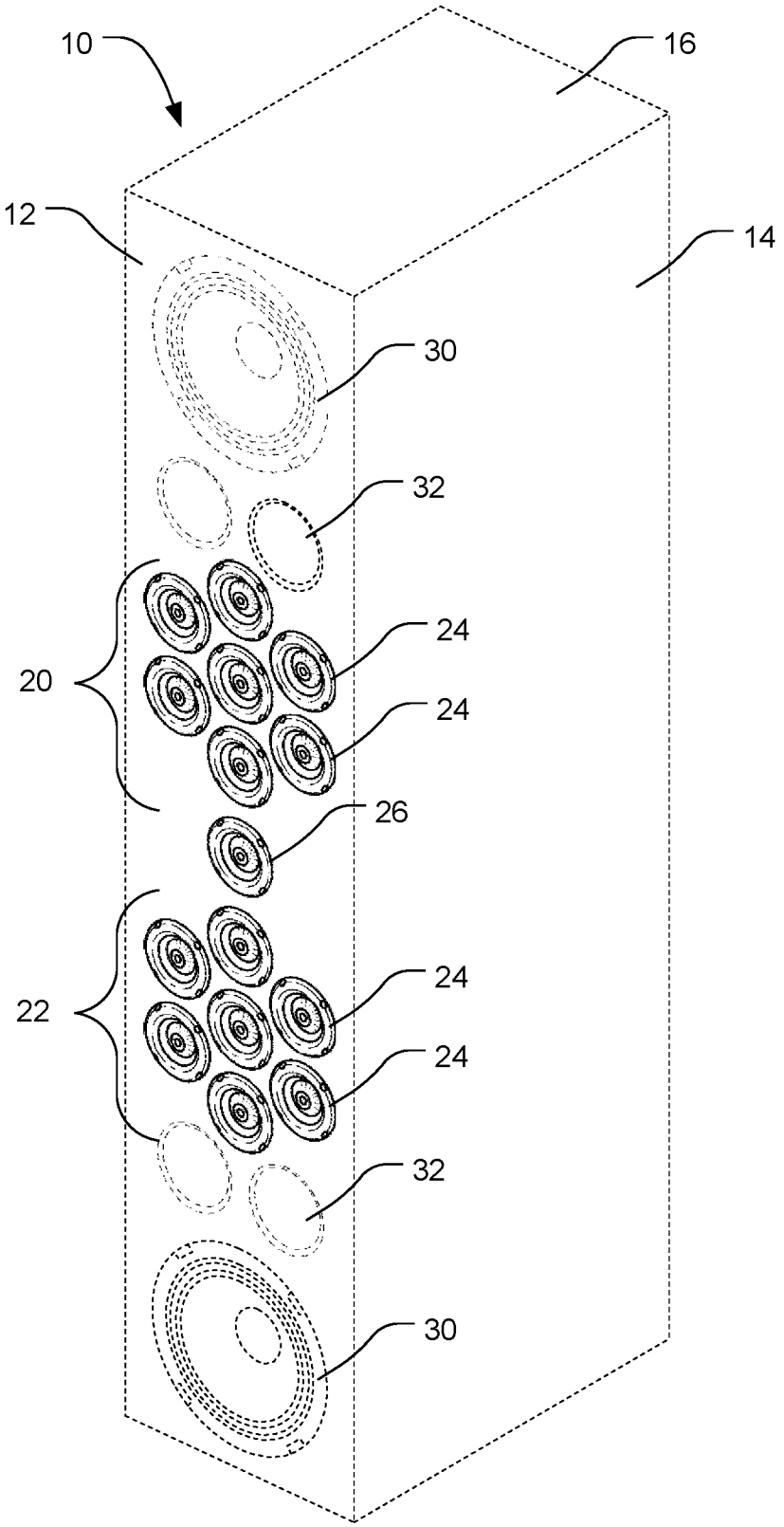
FIG. 1 shows a perspective view of a first loudspeaker configuration.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide an MTM-style loudspeaker in which an array of smaller drivers replaces each of the larger drivers in a traditional MTM design. Doing so reduces the total moving mass of the drivers reproducing the lower-frequency sounds in the MTM design, while still allowing enough air to be moved for the loudspeaker to reproduce sounds in lower frequency ranges that would normally be produced by the larger drivers and could not be adequately produced by a single instance of the smaller driver. For example, a single tweeter or supertweeter, or a pair of tweeters or supertweeters still serves a traditional tweeter or tweeter function in the MTM design (handling high frequencies), but a plurality of tweeters or supertweeters arranged in two arrays placed on either side of the tweeter(s) or supertweeter(s) handling high frequencies is tasked with reproducing lower frequencies not traditionally handled in loudspeakers by tweeters or supertweeters.

According to certain embodiments of the invention, a loudspeaker includes a front panel. A first array of a plurality of a first type of speaker drivers is positioned on the front panel, the first array serving in the place of a first larger type of speaker driver. A second array of a plurality of the first type of speaker driver is positioned on the front panel, the second array serving in the place of a second of the larger type of speaker driver. A single instance of the first type of speaker driver is positioned on the front panel equidistantly between the first array and the second array. A crossover is configured to pass a first audio signal encompassing an upper frequency range with a lower frequency range filtered out to the single instance of the first type of speaker driver and to pass a second audio signal encompassing the lower frequency range with the higher frequency range filtered out to all the speaker drivers of the first and second arrays. The first type of speaker driver may be a supertweeter, a tweeter, a mid-range driver or a midwoofer driver. Each of the arrays may have any number of the first type of speaker driver, such as two, three, four, five, six, seven, or more drivers.

In some instances, an additional larger speaker driver may be positioned on the front panel such that the first array is positioned between the additional larger speaker driver and the single instance of the first type of speaker driver. Similarly, a second additional larger speaker driver may be positioned on the front panel such that the second array is positioned between the second additional larger speaker driver and the single instance of the first type of speaker driver. In some instances, four additional mid-sized speaker drivers of a size between the size of the first type of speaker driver and the additional larger speaker driver may be provided, with a pair of the mid-sized speaker drivers being positioned on the front panel between one of the arrays and the nearest larger speaker driver. In other instances, two additional mid-sized speaker drivers of a size between the size of the first type of speaker driver and the additional larger speaker driver, with one of the mid-sized speaker drivers being positioned on the front panel between each of the arrays and the nearest larger speaker driver. In additional instances, an additional still-larger speaker driver may be positioned on the front panel apart from the first and second arrays and the single instance of the first type of speaker driver.

According to additional embodiments of the invention, a loudspeaker includes a front panel. A first array of a plurality of a first type of speaker drivers is positioned on the front panel, the first array serving in the place of a first larger type of speaker driver. A second array of a plurality of the first type of speaker driver is positioned on the front panel, the second array serving in the place of a second of the larger type of speaker driver. Two instances of the first type of speaker driver are positioned on the front panel equidistantly between the first array and the second array. A crossover is configured to pass a first audio signal encompassing an upper frequency range with a lower frequency range filtered out to the two instances of the first type of speaker driver and to pass a second audio signal encompassing the lower frequency range with the higher frequency range filtered out to all the speaker drivers of the first and second arrays. The first type of speaker driver may be a supertweeter, a tweeter, a mid-range driver or a midwoofer driver. Each of the arrays may have any number of the first type of speaker driver, such as two, three, four, five, six, seven, or more drivers.

In some instances, an additional larger speaker driver may be positioned on the front panel such that the first array is positioned between the additional larger speaker driver and the two instances of the first type of speaker driver. Similarly, a second additional larger speaker driver may be positioned on the front panel such that the second array is positioned between the second additional larger speaker driver and the two instances of the first type of speaker driver. In some instances, four additional mid-sized speaker drivers of a size between the size of the first type of speaker driver and the additional larger speaker driver may be provided, with a pair of the mid-sized speaker drivers being positioned on the front panel between one of the arrays and the nearest larger speaker driver. In other instances, two additional mid-sized speaker drivers of a size between the size of the first type of speaker driver and the additional larger speaker driver, with one of the mid-sized speaker drivers being positioned on the front panel between each of the arrays and the nearest larger speaker driver. In additional instances, an additional still-larger speaker driver may be positioned on the front panel apart from the first and second arrays and the two instances of the first type of speaker driver.

According to further embodiments of the invention, a loudspeaker includes a front panel, a first array of a plurality of tweeters positioned on the front panel, the first array serving in the place of a first larger type of speaker driver, and a second array of a plurality of the tweeters positioned on the front panel, the second array serving in the place of a second of the larger type of speaker driver. The speaker also includes a single instance of the tweeter, positioned on the front panel equidistantly between the first array and the second array and a crossover configured to pass a first audio signal encompassing an upper frequency range with a lower frequency range filtered out to the single instance of the tweeter and to pass a second audio signal encompassing the lower frequency range with the higher frequency range filtered out to all the tweeters of the first and second arrays.

The loudspeaker may also include an additional larger speaker driver positioned on the front panel such that the first array is positioned between the additional larger speaker driver and the single instance of the tweeter. The loudspeaker may also include a second additional larger speaker driver positioned on the front panel such that the second array is positioned between the second additional larger speaker driver and the single instance of the tweeter. Each of the first and second arrays may have any number of tweeters, such as two, three, four, five, six, seven, or more tweeters.

Figure 3:
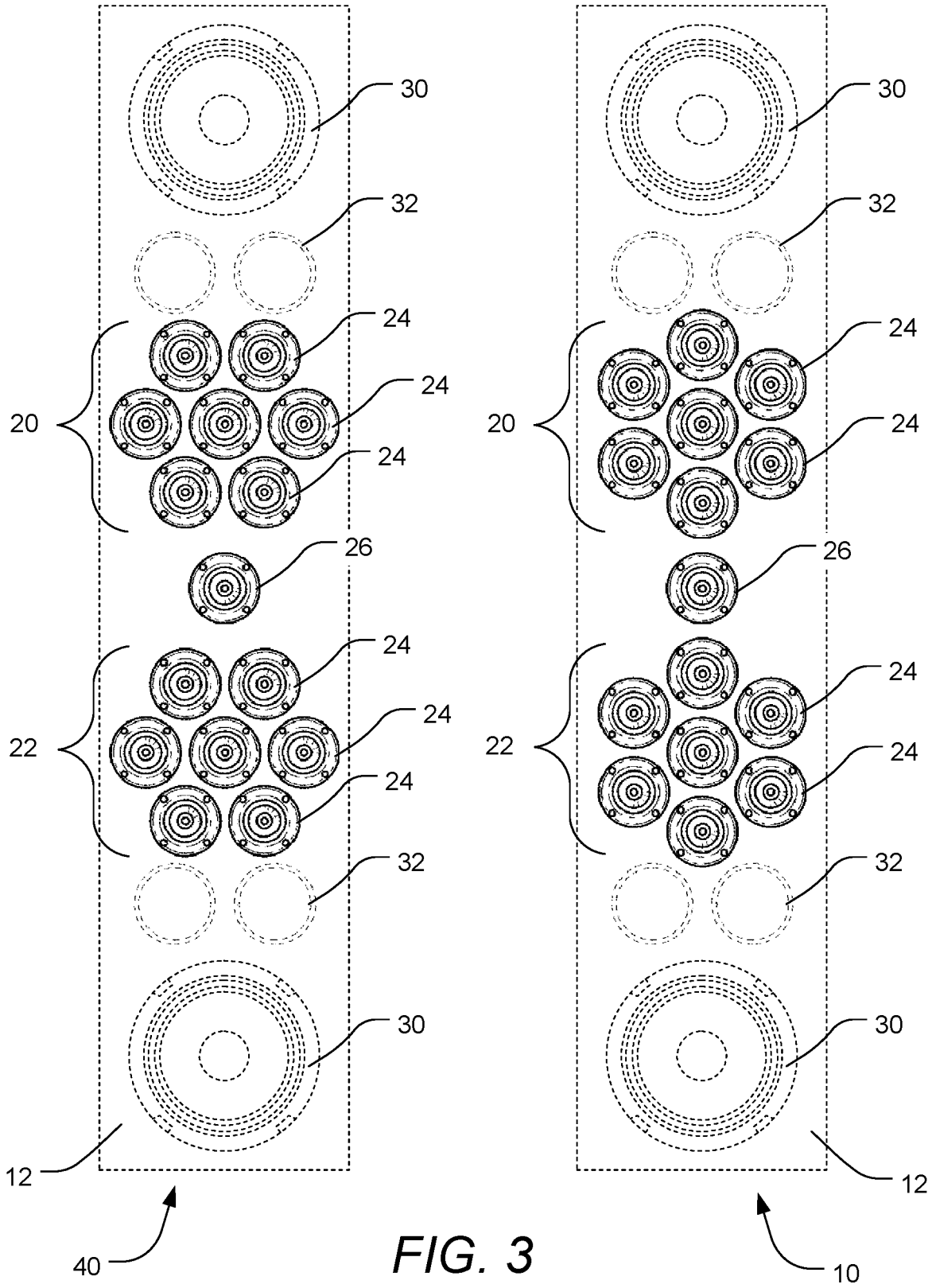
FIG. 3 shows front views of the first and second loudspeaker configurations.

FIG. 1 shows a perspective view of a first loudspeaker 10 in accordance with embodiments of the invention. FIG. 3 shows a front view of the loudspeaker 10. The first loudspeaker 10 generally includes an enclosure formed of a front panel 12, side panels 14, a back panel (not shown), a top panel 16, and a bottom panel (not shown), with the loudspeaker 10 assuming a general shape of a rectangular prism. The loudspeaker 10 may generally assume other desired shapes for acoustic, design, or aesthetic purposes, without generally affecting the functionality described herein, and those of ordinary skill in the loudspeaker design art will generally be aware of design considerations such as enclosure volume, etc. applicable in designing the dimensions of the loudspeaker 10 regardless of the final shape of the enclosure.

The front panel 12 generally houses a variety of speaker drivers, the speaker drivers being transducers that transduce electrical signals into sound, as is known in the art. The front panel 12 is generally planar so that sounds emanating from the various drivers of the speaker will generally be phase matched, or so that phase matching can be achieved based on known positions (e.g. depths) of all the drivers on the front panel 12.

In the loudspeaker 10, a first array 20 and a second array 22 of tweeters 24 serves the function of first and second midwoofer speakers in an MTM design. Thus, while in a traditional loudspeaker design, tweeters such as tweeters 24 are typically tasked with handling only frequencies of a higher range, in the loudspeaker 10, the tweeters 24 of the first array 20 and the second array 22 are tasked with handling frequencies lower than tweeters are typically driven. The reason tweeters are typically not driven at lower frequencies in traditional loudspeaker designs is that the smaller surface area of tweeters means that they do not move enough air at lower frequencies to reach desired volumes.

Implementation of the invention provides an MTM loudspeaker in which an array of smaller drivers replaces each of the larger drivers in a traditional MTM design. Doing so reduces the total moving mass of the drivers reproducing the lower-frequency sounds in the MTM design, while still allowing enough air to be moved for the loudspeaker to reproduce sounds in lower frequency ranges that would normally be produced by the larger drivers and could not be adequately produced by a single instance of the smaller driver. For example, a single tweeter or supertweeter, or a set of (e.g., a pair or a few) tweeters or supertweeters still serves a traditional tweeter or tweeter function in the MTM design (handling high frequencies), but a plurality of tweeters or supertweeters arranged in two arrays (e.g., the first array 20 and the second array 22) placed on either side of the tweeter(s) or supertweeter(s) handling high frequencies is tasked with reproducing lower frequencies not traditionally handled in loudspeakers by tweeters or supertweeters.

This arrangement provides certain benefits to the loudspeaker 10. The first and second arrays of tweeters 20, 22 jointly have sufficient surface area to achieve desired volumes at desired lower-than-traditional-tweeter frequencies, but the total moving mass of the first and second arrays of tweeters 20, 22 is sufficiently low as to be generally comparable to the moving mass of the instrument or other sound source that was originally recorded. In this way, the loudspeaker 10 is able to achieve more faithful reproduction of sound than are traditional loudspeakers. Additionally, the configuration of the loudspeaker 10 with two arrays of tweeters 24 located on either side of a central tweeter 26 allows the loudspeaker 10 to retain the advantages of traditional MTM loudspeakers (e.g., reduced or eliminated lobe tilting).

Loudspeakers in accordance with embodiments of the invention may include any number of additional drivers tasked with handling or configured to handle (e.g., using applicable analog or digital crossovers or other frequency handling circuitry) certain ranges of frequencies. For example, the loudspeaker 10 may include one or more bass drivers 30 and one or more midbass drivers 32. Where both bass drivers 30 and midbass drivers 32 are present, the loudspeaker 10 may be configured to pass a lowest range of frequencies to the bass driver(s) 30, to pass a higher range of frequencies to the midbass driver(s) 32, to pass a still higher range of frequencies to the first array 20 of tweeters 24 and to the second array 22 of tweeters 24, and a highest range of frequencies to the central tweeter or tweeters 26. As is known in the loudspeaker design art, the ranges of frequencies sent to each driver or array of drivers may overlap somewhat with the immediately lower and/or higher ranges of frequencies sent to other drivers and/or arrays of drivers.

Where only bass drivers 30 or midbass drivers 32 are present, the loudspeaker 10 may be configured to pass a lowest range of frequencies to the bass driver(s) 30 or the midbass driver(s) 32 (whichever is/are present), to pass a higher (middle) range of frequencies to the first array 20 of tweeters 24 and to the second array 22 of tweeters 24, and a highest range of frequencies to the central tweeter or tweeters 26. As is known in the loudspeaker design art, the ranges of frequencies sent to each driver or array of drivers may overlap somewhat with the immediately lower and/or higher ranges of frequencies sent to other drivers and/or arrays of drivers.

The loudspeaker 10 may also include one or more ports or vents venting an interior of the cabinet or enclosure of the loudspeaker 10 to the exterior of the cabinet or enclosure of the loudspeaker 10. Such ports may fire in any direction, including front, back, up, down, or sideways, as is known in the loudspeaker design art. Such ports may be formed in any desirable shape or size as desired according to traditional loudspeaker design principles.

As is specifically shown in FIG. 1, the loudspeaker 10 includes upper and lower pairs of midbass drivers 32. The loudspeaker 10 also includes upper and lower bass drivers 30. As each of the bass drivers 30 and midbass drivers 32 is symmetrically paired on the loudspeaker 10, there are no issues with respect to lobe tilting of the loudspeaker 10 at any frequency.

In the loudspeaker 10 of FIGS. 1 and 3, each of the first array 20 and the second array 22 of tweeters 24 includes seven tweeters 24 arranged in a hexagonal pattern with a central tweeter 24 disposed within six other tweeters 24 arranged hexagonally. The arrays 20, 22 are positioned such that three tweeters 24 are positioned centrally in a vertical line with two additional tweeters 24 that are positioned in vertical lines to either side of the central line of tweeters 24. As may be seen in FIGS. 1 and 3, the tweeters 24 are each spaced identically from immediately adjacent other tweeters 24. Optionally, the central tweeter 26 may also be identically spaced apart from the immediately adjacent tweeters 24 in the first array 20 of tweeters 24 and the second array 22 of tweeters 24, though as shown in FIGS. 1 and 3, a different amount of space may separate the central tweeter 26. Thus, FIGS. 1 and 3 represent one possible arrangement and rotation of an array of tweeters 24.

Figure 2:
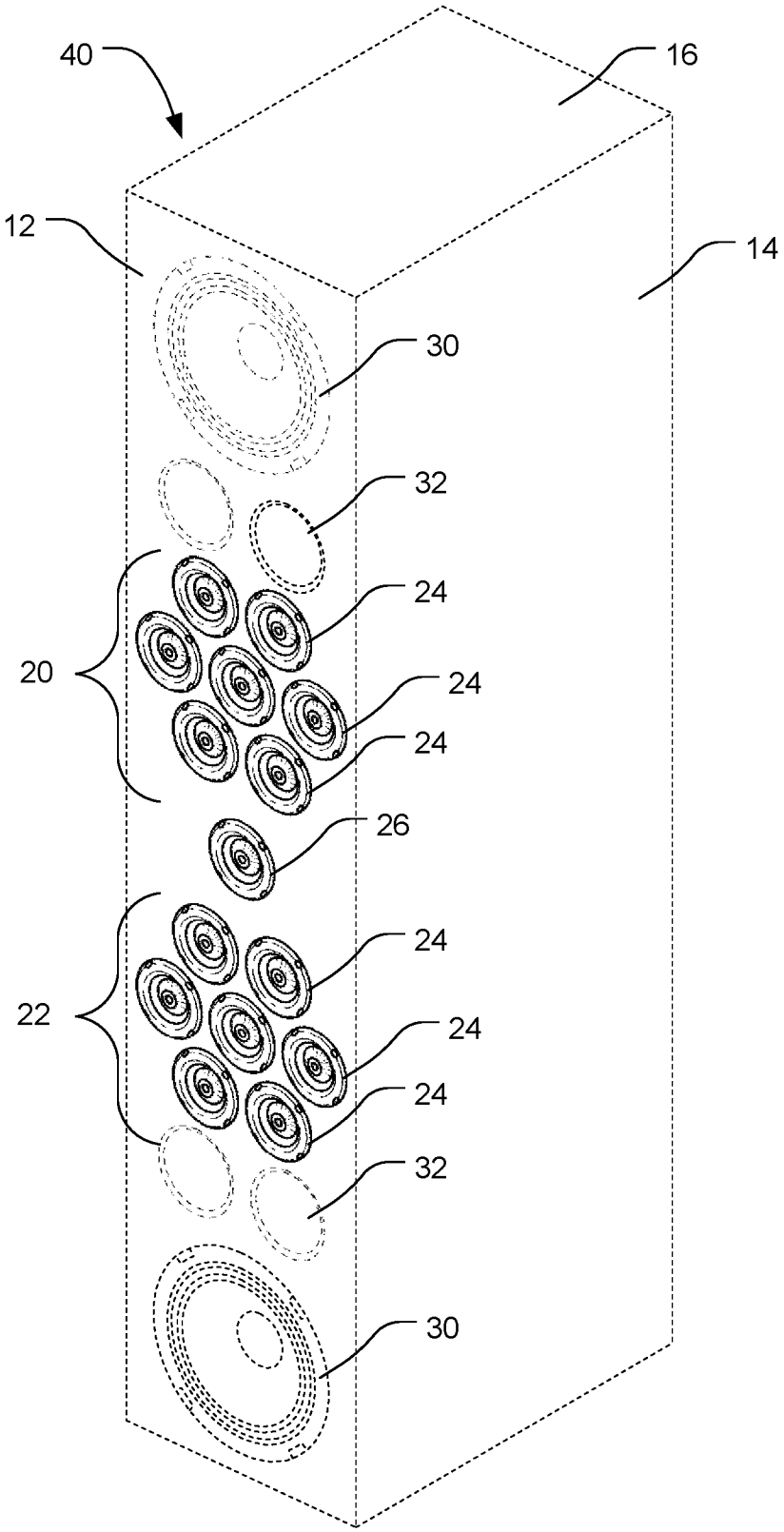
FIG. 2 shows a perspective view of a second loudspeaker configuration.

The arrays 20, 22 of tweeters 24 may be rotated to any other rotational angle for aesthetic or other purposes while still performing their function of acting in the place of a single, larger driver while reducing the total moving mass. For example, FIGS. 2 and 3 illustrate an alternative loudspeaker 40. As may be particularly seen in the front view of FIG. 3 that illustrates both loudspeaker 10 and loudspeaker 40, the components of loudspeaker 10 and loudspeaker 40 may be identical, and the size and shape of the enclosure may be identical as well. Additionally, the placement of the bass driver(s) 30, the midbass driver(s) 32, and the central tweeter 26 may also be identical in the loudspeaker 10 and the loudspeaker 40. Additionally, the center of rotational symmetry of each of the first array 20 of tweeters 24 and the second array 22 of tweeters 24 may be identical in the loudspeaker 10 and the loudspeaker 40.

Accordingly, the only difference between loudspeaker 10 and loudspeaker 40 may be the rotational position of the first array 20 of tweeters 24 and of the second array 22 of tweeters 24. Thus, where the tweeters 24 in the arrays 20, 22 of loudspeaker 10 are arranged with three tweeters 24 positioned centrally in a vertical line and with two tweeters 24 in a vertical line on either side of the central tweeters 24, the tweeters 24 in the arrays 20, 22 of loudspeaker 40 are arranged with three tweeters 24 positioned centrally (with respect to the respective array 20, 22) in a horizontal line and with two tweeters 24 in a horizontal line on either side of the central tweeters 24. Accordingly, the arrays 20, 22 of loudspeaker 40 are effectively rotated thirty degrees (either to the left or right) with respect to the arrays 20, 22 of loudspeaker 10. Any other intermediate rotation may be used without modifying the functionality of the arrays 20, 22.

Figure 4:
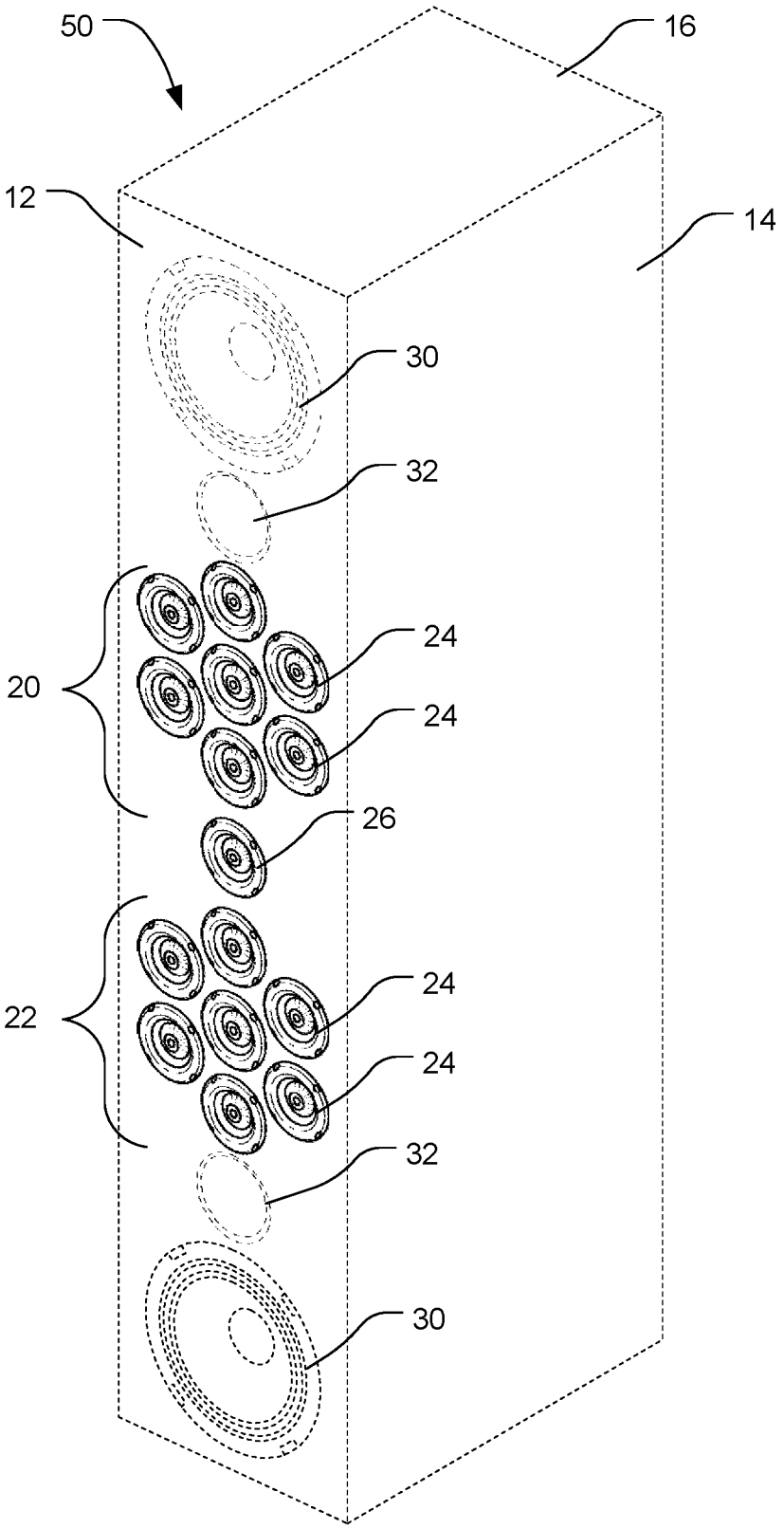
FIGS. 4 and 5 show perspective views of third and fourth loudspeaker configurations.
Figure 5:
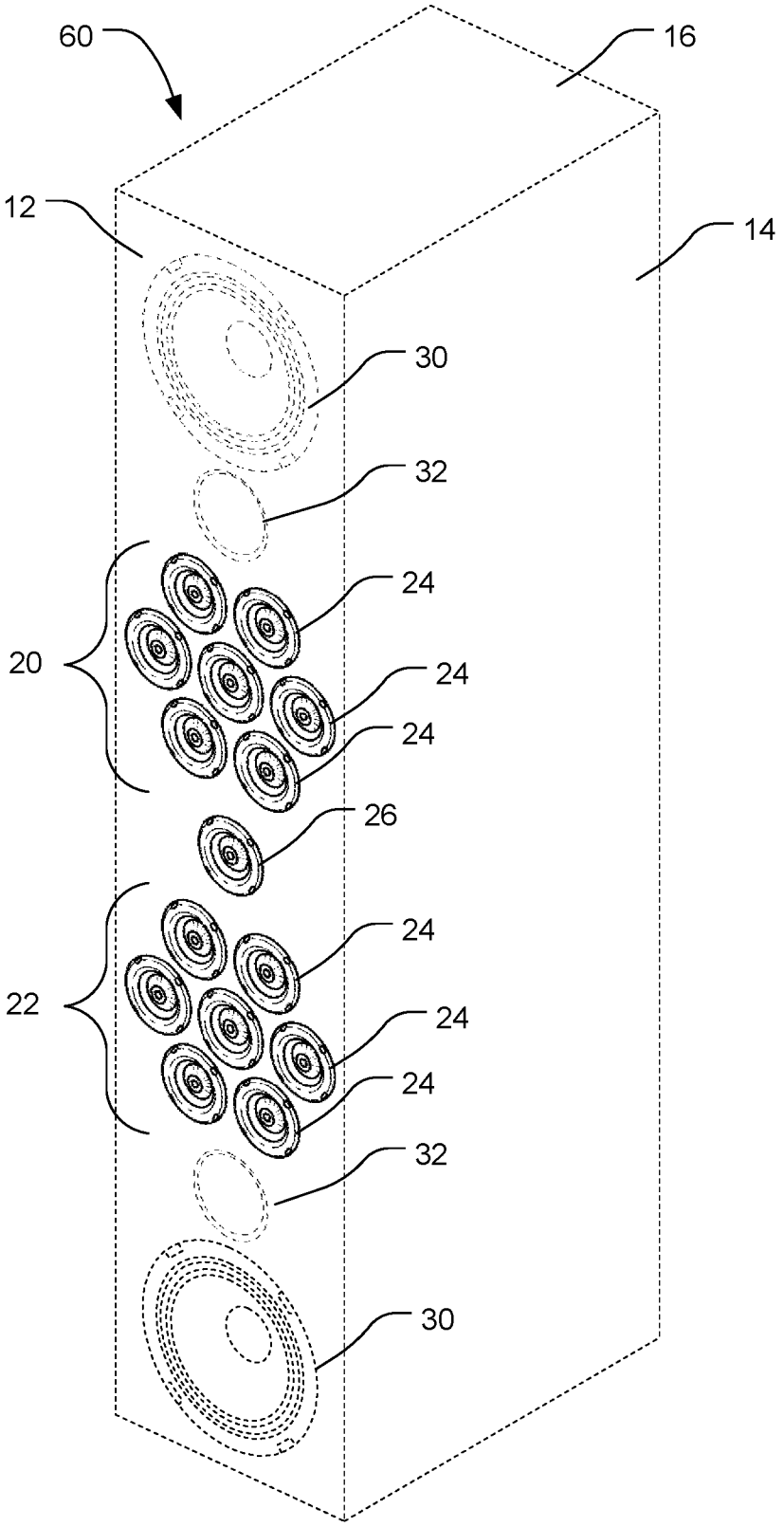

As discussed, loudspeakers may be designed to have any of a variety of drivers accompanying the arrays 20, 22 of tweeters 24. Accordingly, FIG. 4 shows an alternate loudspeaker 50 that includes the arrays 20, 22 of tweeters 24 and the central tweeter 26. Loudspeaker 50 also includes two bass drivers 30 at opposite ends of the front panel 12 and two midbass drivers 32, one each between one of the bass drivers and the immediately adjacent array 20, 22. FIG. 5 shows an alternate loudspeaker 60 that is largely similar to loudspeaker 40, except that the arrays 20, 22 are rotated thirty degrees with respect to the arrays 20, 22 of loudspeaker 40. In both loudspeaker 50 and loudspeaker 60, each array 20, 22 has seven tweeters 24, as with loudspeakers 10, 40. Alternate loudspeakers could have different numbers of tweeters 24 in each array 20, 22, as desired (see, e.g., FIGS. 10-14), but could otherwise have other drivers similar to the drivers shown in any of the embodiments of FIGS. 1-5.

Figure 6:
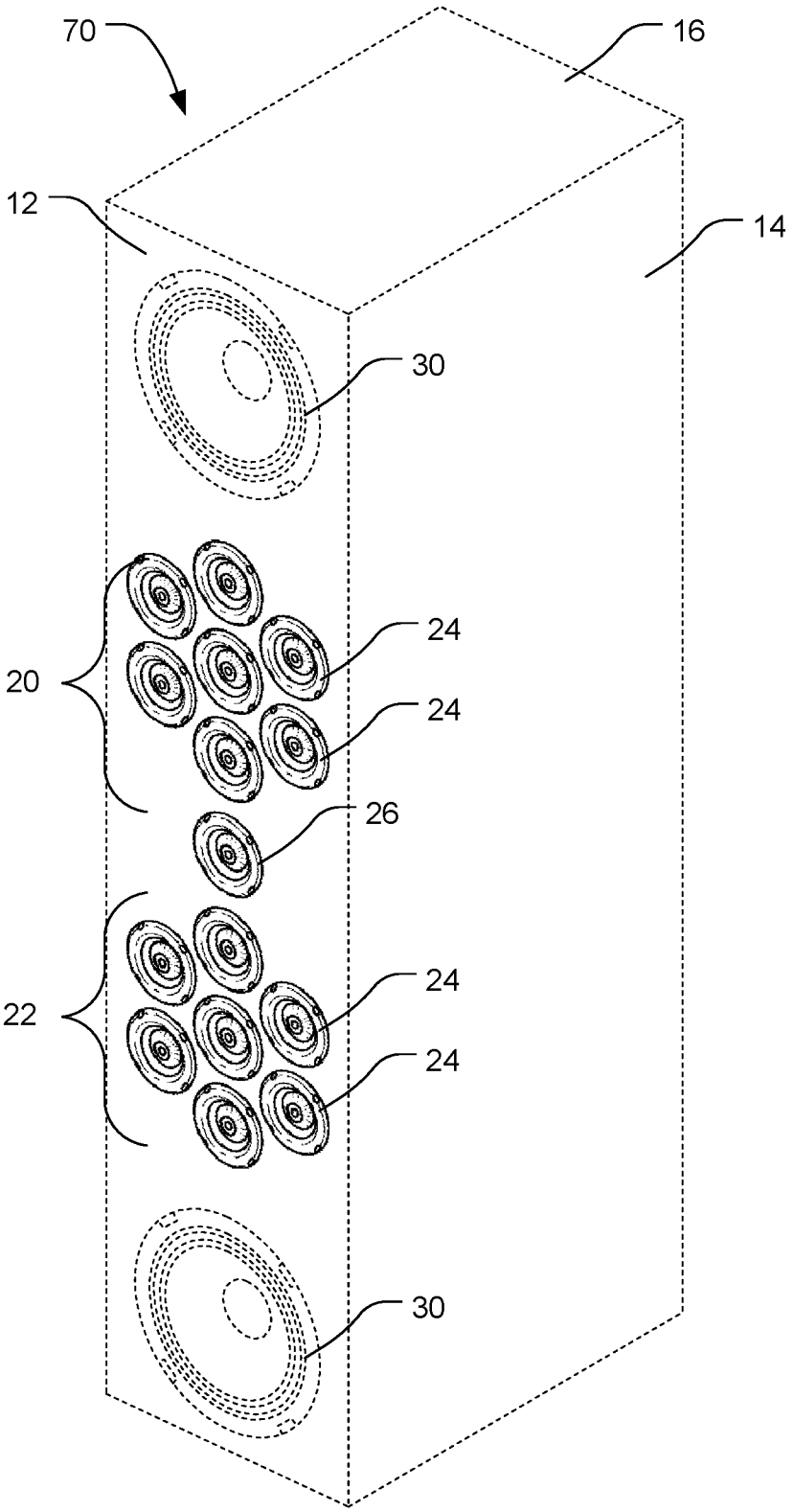
FIGS. 6 and 7 show perspective views of fifth and sixth loudspeaker configurations.
Figure 7:
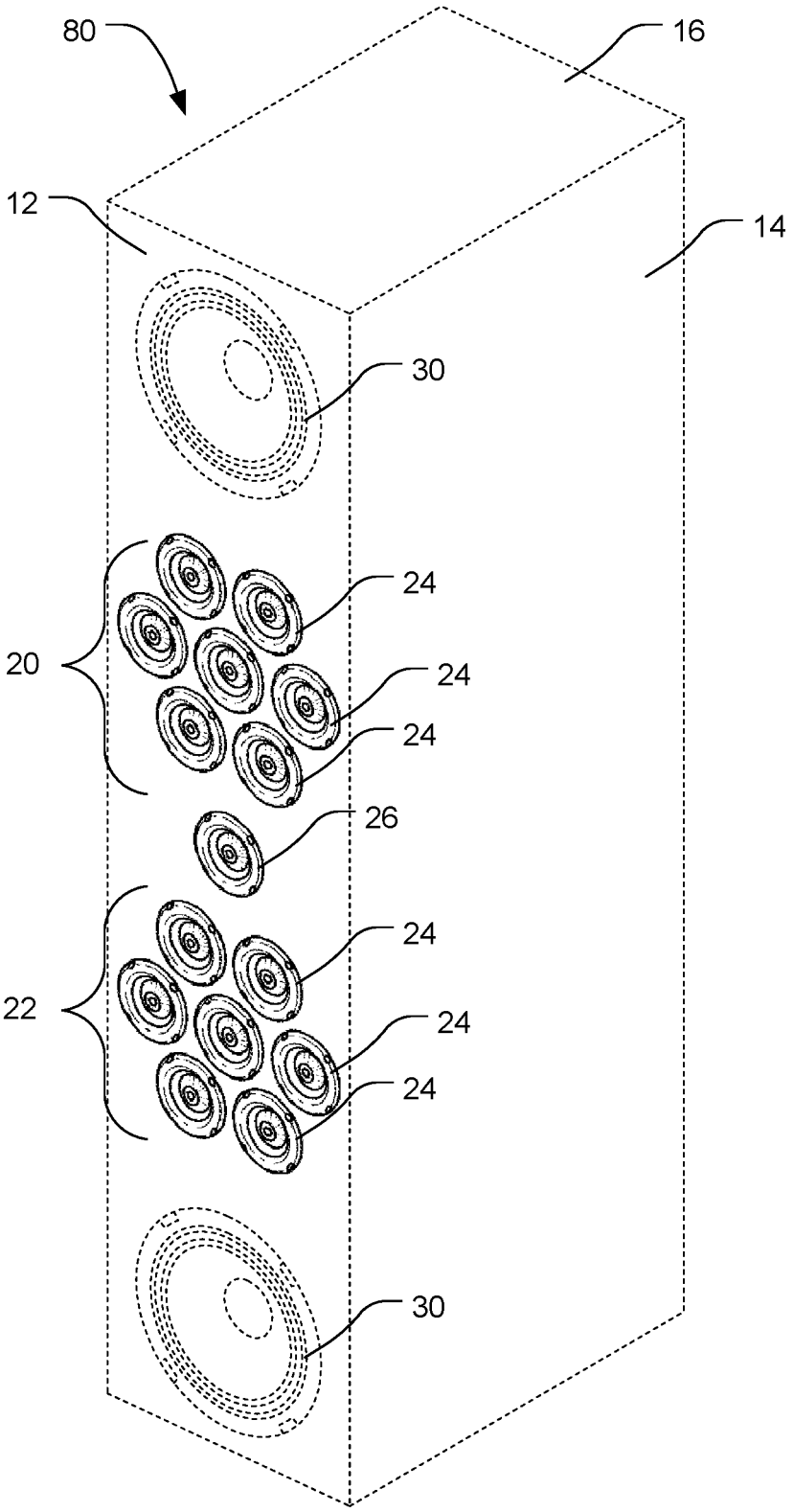

FIG. 6 illustrates an alternate loudspeaker 70. This loudspeaker 70 includes arrays 20, 22 of tweeters 24 and the central tweeter 26 as previously discussed. In this instance, the arrays 20, 22 each include three tweeters 24 centrally aligned on a vertical axis, with two additional tweeters 24 to either side, as previously discussed. This loudspeaker 70 also includes two bass drivers 30 positioned at opposite ends of the front panel 12, with one bass driver adjacent to each array 20, 22. The loudspeaker 70 does not include any midbass drivers 32. FIG. 7 shows an alternate loudspeaker 80 that is in all regards similar to loudspeaker 70, except that the arrays 20, 22 of tweeters 24 are rotated thirty degrees relative to the rotation of the arrays 20, 22 in loudspeaker 70.

Alternate loudspeakers (not shown) might omit the bass drivers 30 in favor of midbass drivers 32.

Figure 8:
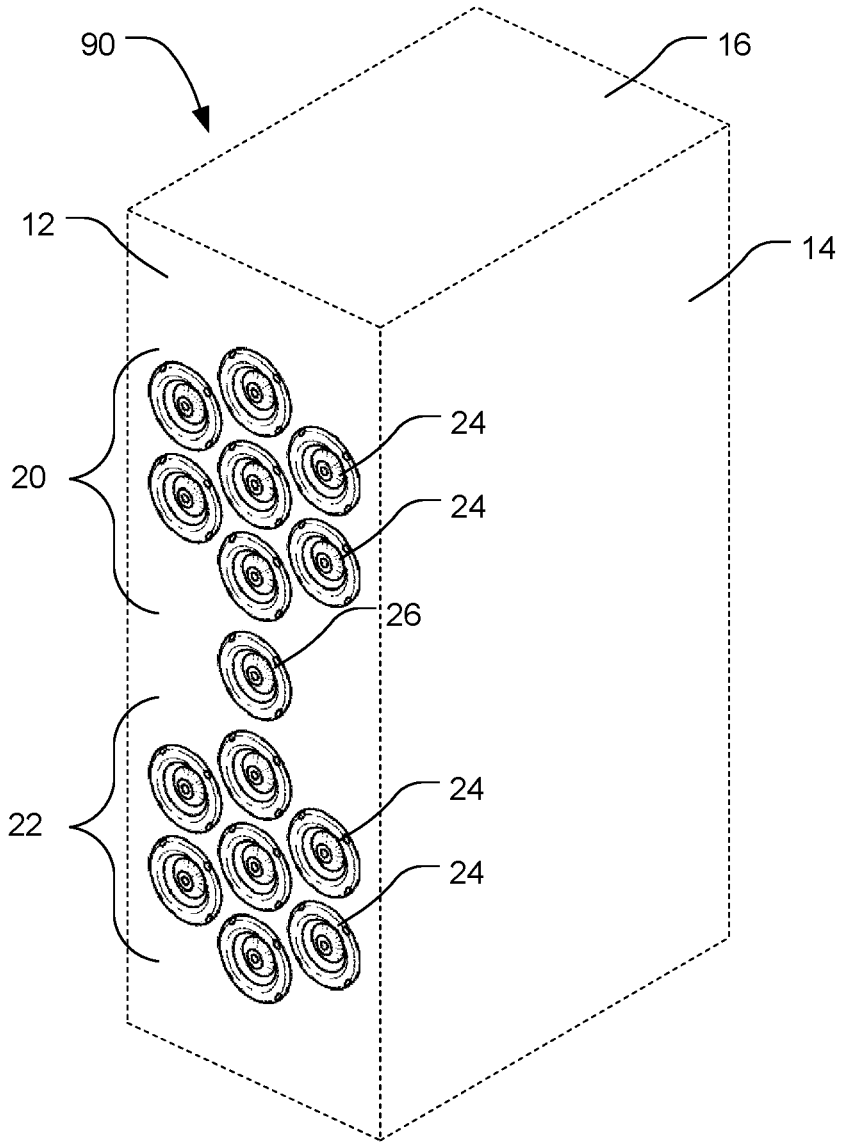
FIGS. 8 and 9 show perspective views of seventh and eighth loudspeaker configurations.
Figure 9:
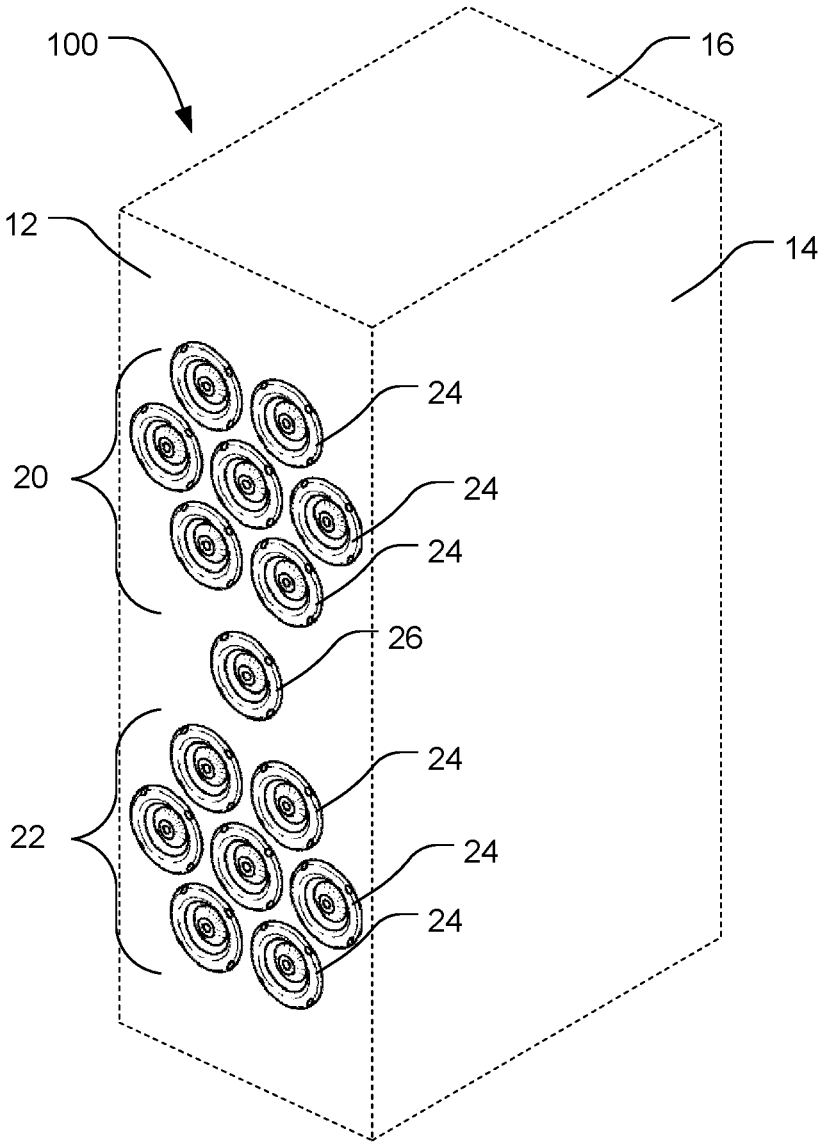

FIGS. 8 and 9 illustrate an alternate loudspeaker 90 and an alternate loudspeaker 100, respectively. In these examples, the arrays 20, 22 of tweeters 24 and the central tweeter 24 are present, and no other drivers are present in the loudspeakers 90, 100. As with the other examples previously given, the arrays 20, 22 of loudspeaker 90 and loudspeaker 100 are rotated thirty degrees with respect to one another. Alternate rotations are possible, as with all examples previously given and discussed. The loudspeaker 90 and loudspeaker 100 may be particularly suitable for use in systems in which lower frequencies are handled by separate dedicated loudspeakers (e.g. woofers or subwoofers).

Figure 10:
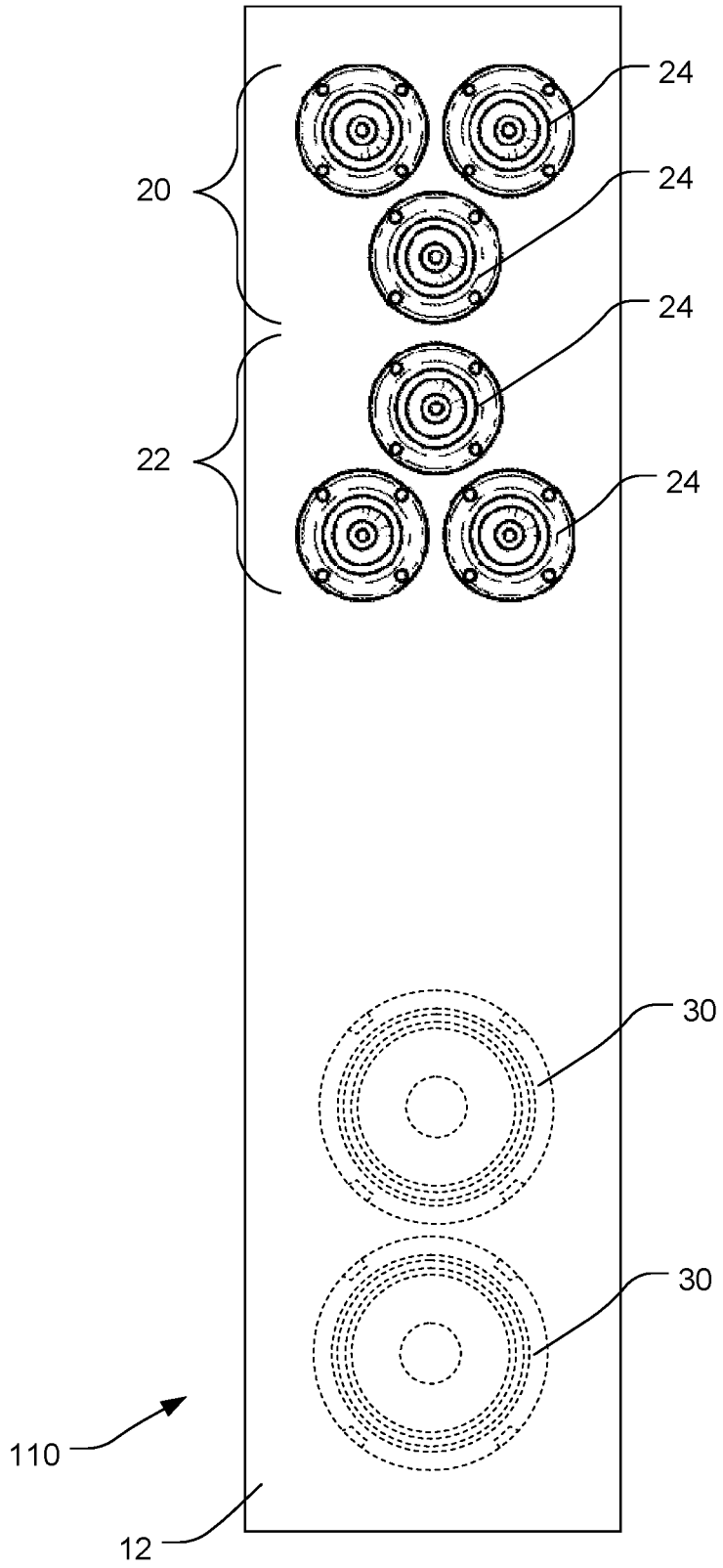
FIG. 10 shows a front view of a ninth loudspeaker configuration.

FIG. 10 illustrates an alternate loudspeaker 110. In loudspeaker 110, the arrays 20, 22 of tweeters 24 are present, but there is no separate central tweeter 26. Instead, one or more of the tweeters 24 in the arrays 20, 22 may be tasked with handling an uppermost range of frequencies. Each of the arrays 20, 22 of loudspeaker 110 of this example includes three tweeters 24. Thus, loudspeaker 110 is an example of a system having three drivers in an array of drivers. Loudspeaker 110 also includes two bass drivers 30, although alternate embodiments may include a single bass driver 30, one bass driver 30 and one midbass driver 32, a single midbass driver 32, or two midbass drivers 32, or any other number of bass drivers 30 and midbass drivers 32 as desired and appropriate. The bass drivers 30 in this example are both positioned near one end of the front panel 12, while the arrays 20, 22 are positioned near an opposite end of the front panel 12. Positioning of the arrays 20, 22 and other drivers, if present, may be varied for aesthetic or acoustic purposes. Having fewer tweeters 24 in the arrays 20, 22 and fewer other drivers (e.g., bass driver 30 and/or midbass driver 30) may allow loudspeaker 110 or other similar designs to achieve many of the benefits discussed herein at an overall lower cost. Thus, embodiments of the invention embrace loudspeaker designs of any complexity and cost as may be desired.

Figure 11:
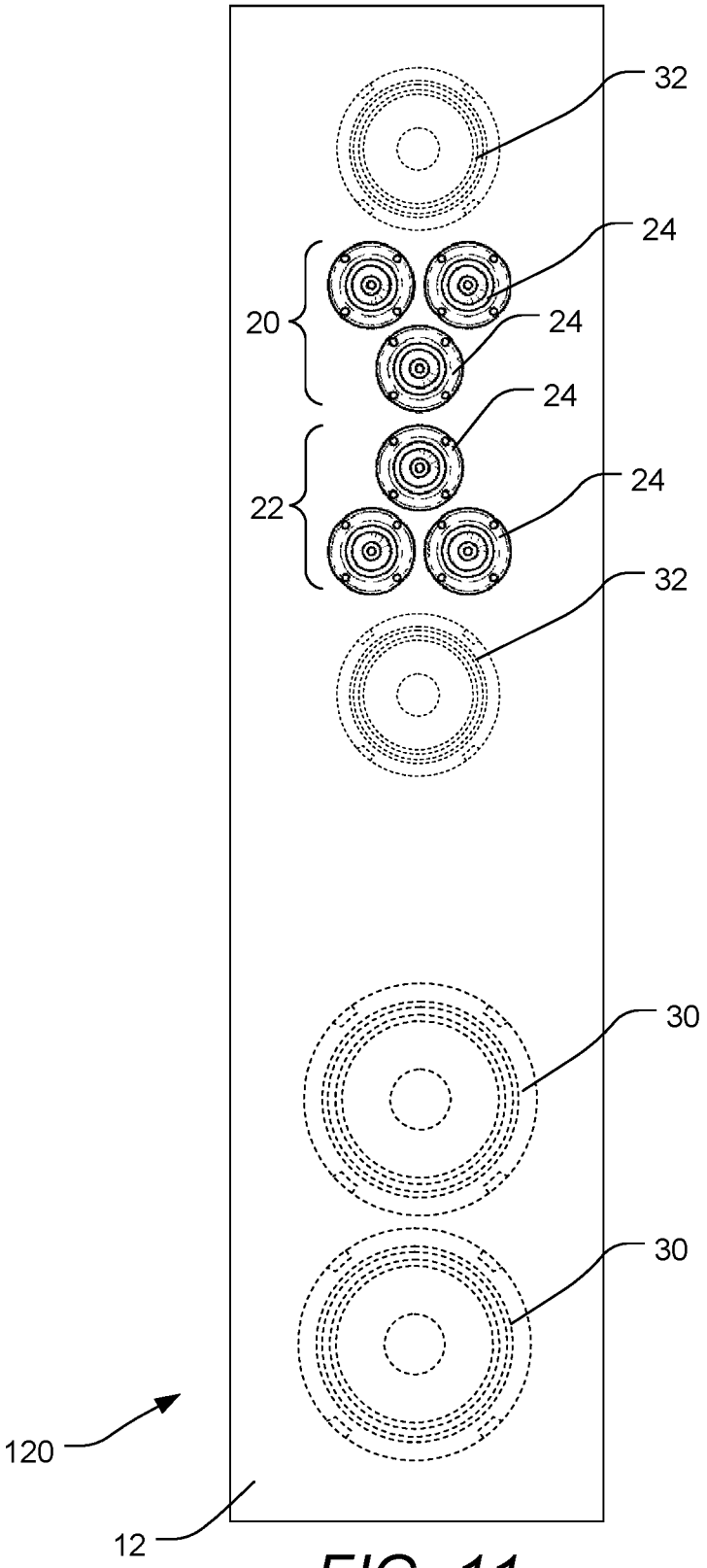
FIG. 11 shows a front view of a tenth loudspeaker configuration.

FIG. 11 illustrates an alternate loudspeaker 120. Loudspeaker 120 includes arrays 20, 22 of tweeters 24 each having three tweeters 24 as discussed with respect to FIG. 10. Additionally, loudspeaker 120 includes two bass drivers 30, again positioned near an end of the front panel 12 distal the end proximate which the arrays 20, 22 are located. In this example, however, loudspeaker 120 includes two midbass drivers 32. In this example, the midbass drivers 32 are positioned adjacent the arrays 20, 22 such that the arrays 20, 22 are positioned between the midbass drivers 32. As discussed previously, other positioning of drivers and arrays 20, 22 may be used.

Figure 12:
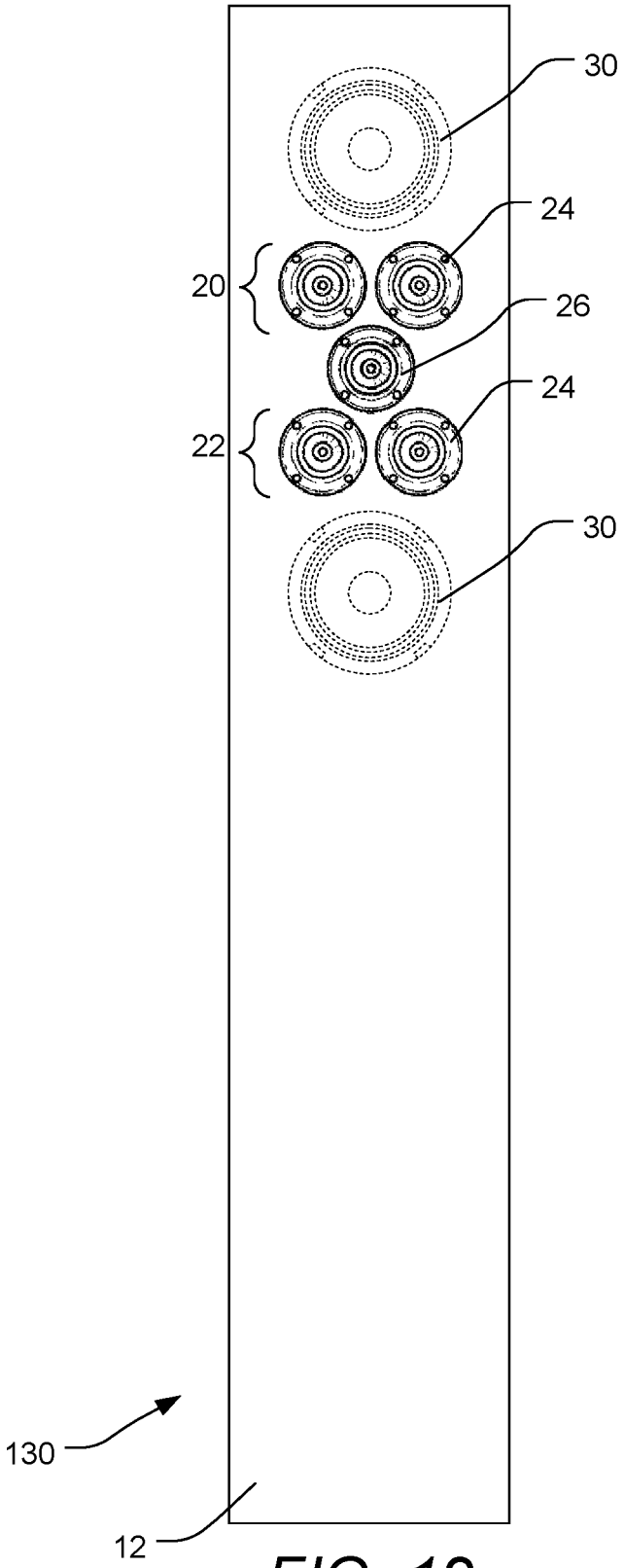
FIG. 12 shows a front view of an eleventh loudspeaker configuration.

FIG. 12 illustrates another alternate loudspeaker 130. In loudspeaker 130, each of the arrays 20, 22 is made up of two tweeters 24, and in this example the central tweeter 26 is present. The loudspeaker 130 also includes two bass drivers 30, positioned at either end of the arrays 20, 22. Alternatively, the bass drivers 30 may be replaced with midbass drivers 32, as discussed in detail above with respect to other embodiments.

Figure 13:
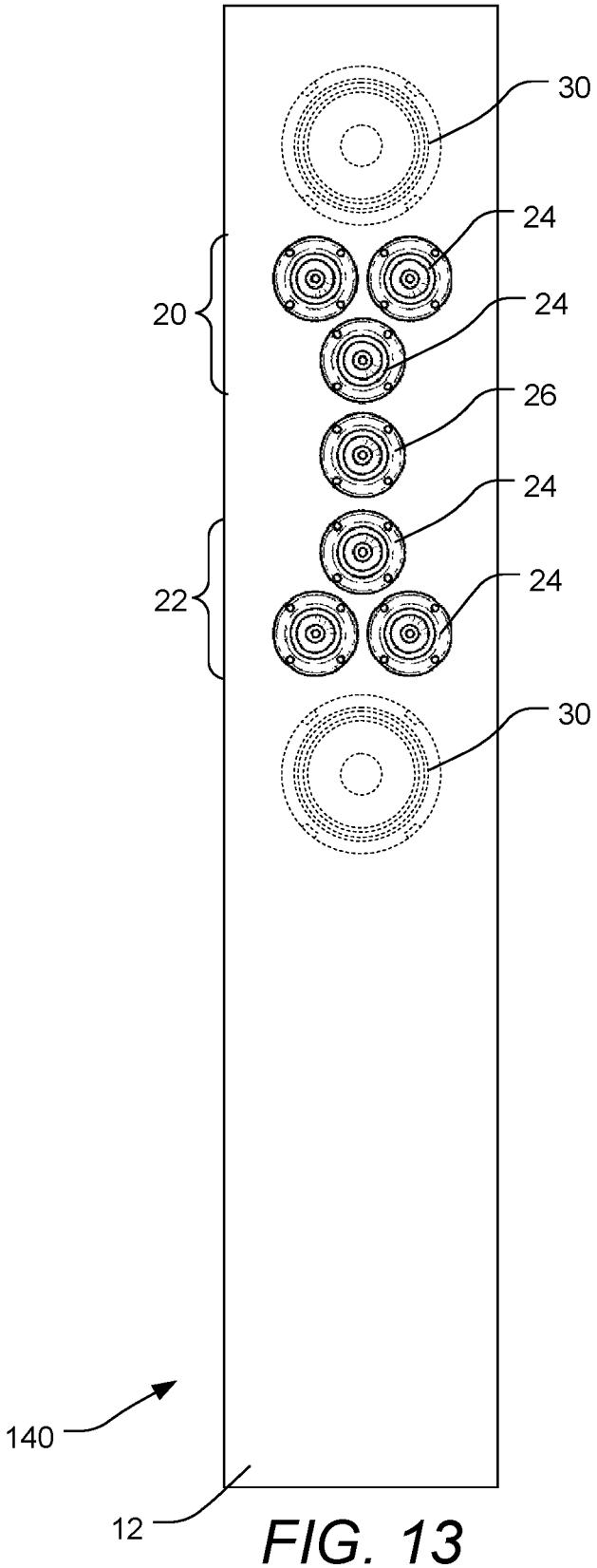
FIG. 13 shows a front view of a twelfth loudspeaker configuration.

FIG. 13 illustrates another alternate loudspeaker 140. In loudspeaker 140, each of the arrays 20, 22 includes three tweeters 24, and the central tweeter 26 is present. Loudspeaker also includes two bass drivers 30 (though an alternate embodiment may include two midbass drivers 32 instead of bass drivers 30), positioned adjacent the arrays 20, 22 such that the arrays 20, 22 and the central tweeter 26 are positioned between the bass drivers 30.

Figure 14:
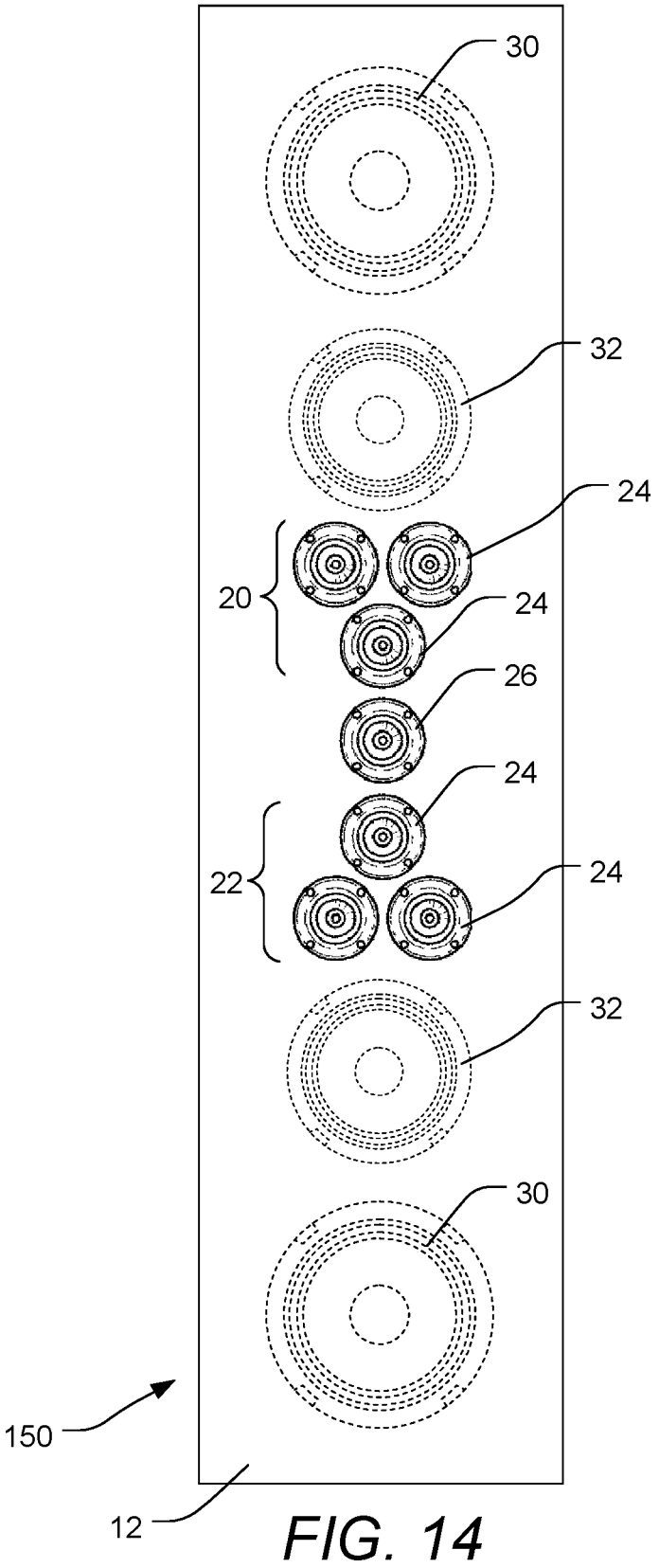
FIG. 14 shows a front view of a thirteenth loudspeaker configuration.

FIG. 14 illustrates another alternate loudspeaker 150. Loudspeaker 150 is similar in design to loudspeaker 50 and loudspeaker 60, except that each of the arrays 20, 22 includes only three tweeters 24 instead of seven tweeters 24. While one rotation of arrays 20, 22 is shown, alternate rotations may be used for any reason, including aesthetic reasons. Alternate embodiments may include more or fewer tweeters 24 in each array 20, 22, as discussed previously.

While embodiments of the invention have been discussed in which arrays of tweeters replace the functionality provided by individual other drivers (often midbass drivers), the principles discussed herein may relate to any speaker design in which an array of smaller drivers replaces the functionality of individual larger drivers. For example, arrays of supertweeters could replace individual tweeters. As another example, arrays of midbass drivers could replace individual bass drivers. As still another example, arrays of bass drivers could replace subbass drivers. As such, embodiments of the invention are not limited to the specific embodiments showing arrays of tweeters or supertweeters. Any embodiments discussed herein in which tweeters are discussed could be alternately described as incorporating supertweeters in the place of tweeters in arrays.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A loudspeaker comprising:

a front panel;

a first array of a plurality of a first size of speaker drivers positioned on the front panel, the first array serving in the place of a first larger size of speaker driver;

a second array of a plurality of the first size of speaker driver positioned on the front panel, the second array serving in the place of a second of the larger size of speaker driver;

a single instance of the first size of speaker driver, positioned on the front panel equidistantly between the first array and the second array;

a crossover configured to pass a first audio signal encompassing an upper frequency range with a lower frequency range filtered out to the single instance of the first size of speaker driver and to pass a second audio signal encompassing the lower frequency range with the higher frequency range filtered out to all the speaker drivers of the first and second arrays.

2. The loudspeaker of claim 1, wherein the first size of speaker driver is selected from the group consisting of:

a supertweeter;

a tweeter;

a mid-range driver; and a midwoofer driver.

3. The loudspeaker of claim 1, further comprising an additional larger speaker driver positioned on the front panel such that the first array is positioned between the additional larger speaker driver and the single instance of the first size of speaker driver.

4. The loudspeaker of claim 3, further comprising a second additional larger speaker driver positioned on the front panel such that the second array is positioned between the second additional larger speaker driver and the single instance of the first size of speaker driver.

5. The loudspeaker of claim 4, further comprising four additional mid-sized speaker drivers of a size between the size of the first size of speaker driver and the additional larger speaker driver, with pairs of the mid-sized speaker drivers being positioned on the front panel between each of the arrays and the nearest larger speaker driver.

6. The loudspeaker of claim 4, further comprising two additional mid-sized speaker drivers of a size between the size of the first size of speaker driver and the additional larger speaker driver, with one of the mid-sized speaker drivers being positioned on the front panel between each of the arrays and the nearest larger speaker driver.

7. The loudspeaker of claim 4, further comprising an additional still-larger speaker driver positioned on the front panel apart from the first and second arrays and the single instance of the first size of speaker driver.

8. The loudspeaker of claim 1, wherein each of the first and second arrays comprise a number of the first size of speaker driver selected from the group consisting of two drivers, three drivers, four drivers, six drivers, and seven drivers.

9. A loudspeaker comprising:

a front panel;

a first array of a plurality of a first size of speaker drivers positioned on the front panel, the first array serving in the place of a first larger size of speaker driver;

a second, equal, array of a plurality of the first size of speaker driver positioned on the front panel, the second array serving in the place of a second of the larger size of speaker driver;

two additional instances of the first size of speaker driver, positioned on the front panel equidistantly between the first array and the second array;

a crossover configured to pass a first audio signal encompassing an upper frequency range with a lower frequency range filtered out to the two additional instances of the first size of speaker driver and to pass a second audio signal encompassing the lower frequency range with the higher frequency range filtered out to all the speaker drivers of the first and second arrays.

10. The loudspeaker of claim 9, wherein the first size of speaker driver is selected from the group consisting of:

a supertweeter;

a tweeter;

a mid-range driver; and a midwoofer driver.

11. The loudspeaker of claim 9, further comprising an additional larger speaker driver positioned on the front panel such that the first array is positioned between the additional larger speaker driver and the two additional instances of the first size of speaker driver.

12. The loudspeaker of claim 11, further comprising a second additional larger speaker driver positioned on the front panel such that the second array is positioned between the second additional larger speaker driver and the two additional instances of the first size of speaker driver.

13. The loudspeaker of claim 12, further comprising four additional mid-sized speaker drivers of a size between the size of the first size of speaker driver and the additional larger speaker driver, with pairs of the mid-sized speaker drivers being positioned on the front panel between each of the arrays and the nearest larger speaker driver.

14. The loudspeaker of claim 12, further comprising two additional mid-sized speaker drivers of a size between the size of the first size of speaker driver and the additional larger speaker driver, with one of the mid-sized speaker drivers being positioned on the front panel between each of the arrays and the nearest larger speaker driver.

15. The loudspeaker of claim 12, further comprising an additional still-larger speaker driver positioned on the front panel apart from the first and second arrays and the two additional instances of the first size of speaker driver.

16. The loudspeaker of claim 9, wherein each of the first and second arrays comprise a number of the first size of speaker driver selected from the group consisting of two drivers, three drivers, four drivers, six drivers, and seven drivers.

17. A loudspeaker comprising:

a front panel;

a first array of a plurality of tweeters positioned on the front panel, the first array serving in the place of a first larger size of speaker driver;

a second array of a plurality of the tweeters positioned on the front panel, the second array serving in the place of a second of the larger size of speaker driver;

a single instance of the tweeter, positioned on the front panel equidistantly between the first array and the second array;

a crossover configured to pass a first audio signal encompassing an upper frequency range with a lower frequency range filtered out to the single instance of the tweeter and to pass a second audio signal encompassing the lower frequency range with the higher frequency range filtered out to all the tweeters of the first and second arrays.

18. The loudspeaker of claim 17, further comprising an additional larger speaker driver positioned on the front panel such that the first array is positioned between the additional larger speaker driver and the single instance of the tweeter.

19. The loudspeaker of claim 18, further comprising a second additional larger speaker driver positioned on the front panel such that the second array is positioned between the second additional larger speaker driver and the single instance of the tweeter.

20. The loudspeaker of claim 17, wherein each of the first and second arrays comprise a number of the first size of speaker driver selected from the group consisting of two drivers, three drivers, four drivers, six drivers, and seven drivers.

* * * * *